United States Patent [19]

Mazzoni et al.

[11] 3,971,178

[45] July 27, 1976

[54] ADD-ON MULTIPLE GLAZING WITH HYGROSCOPIC MATERIAL

[75] Inventors: Renato J. Mazzoni, Tarentum; George H. Bowser, New Kensington; Richard R. Lewchuk, Allison Park, all of Pa.

[73] Assignee: PPG Industries, Inc., Pittsburgh, Pa.

[22] Filed: Mar. 25, 1974

[21] Appl. No.: 454,338

[52] U.S. Cl. ..... 52/172; 52/202; 52/203; 52/399; 52/616; 52/741

[51] Int. Cl.[2] ..... E06B 7/12; E06B 3/28

[58] Field of Search ..... 52/202, 203, 172, 173, 52/616, 397, 398, 399, 400, 614, 463, 741, 304

[56] References Cited

UNITED STATES PATENTS

| | | | |
|---|---|---|---|
| 2,756,467 | 7/1956 | Etling | 52/304 X |
| 2,880,475 | 4/1959 | Mills | 52/304 |
| 2,974,377 | 3/1961 | Kunkle | 52/616 |
| 3,105,274 | 10/1963 | Armstrong | 52/616 X |
| 3,226,903 | 1/1966 | Lillethun | 52/475 X |
| 3,299,591 | 1/1967 | Woelk | 52/203 |
| 3,573,149 | 3/1971 | Tibble et al. | 52/616 X |
| 3,733,237 | 5/1973 | Wolff | 52/172 X |
| 3,791,910 | 2/1974 | Bowser | 52/172 X |

*Primary Examiner*—Ernest R. Purser
*Assistant Examiner*—Leslie A. Braun
*Attorney, Agent, or Firm*—Dennis G. Millman

[57] ABSTRACT

An additional pane is added to an existing glazing installation to provide an insulating, sealed airspace therebetween.

32 Claims, 28 Drawing Figures

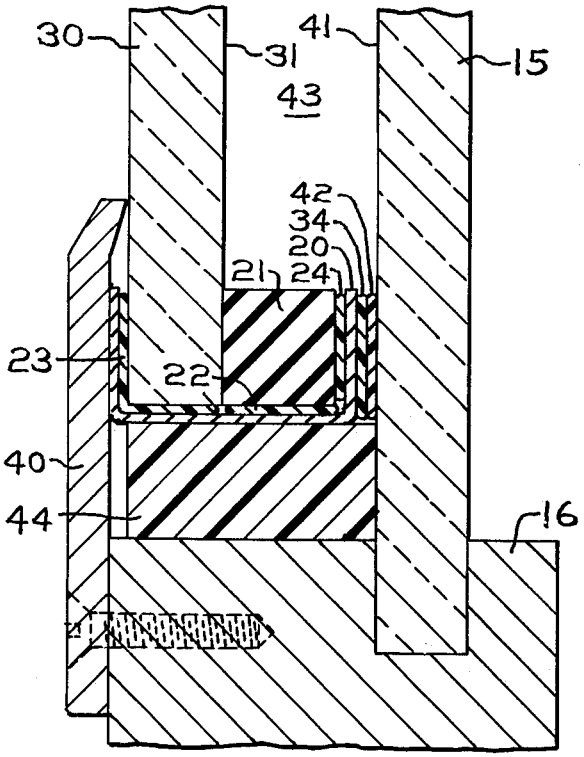
FIG. 9
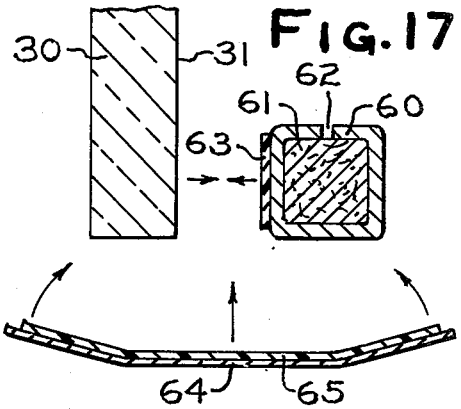
FIG. 17
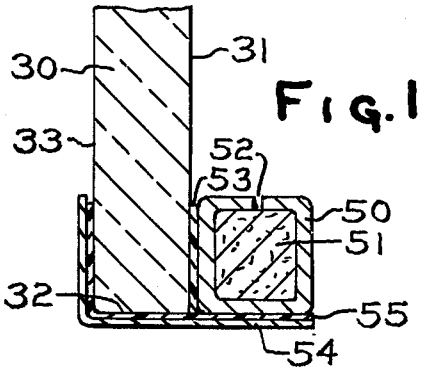
FIG. 15
FIG. 18
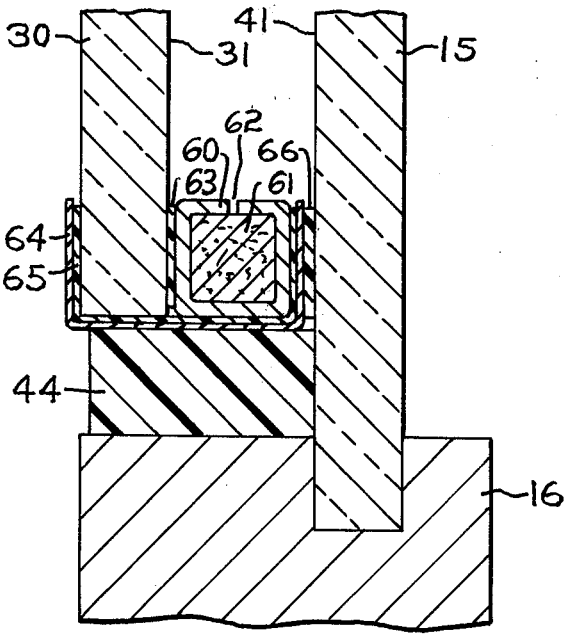
FIG. 16
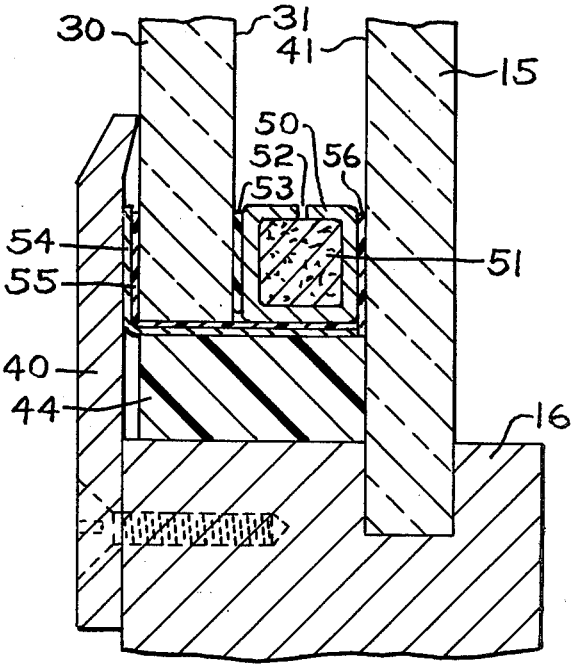

ADD-ON MULTIPLE GLAZING WITH HYGROSCOPIC MATERIAL

BACKGROUND OF THE INVENTION

This invention relates to the conversion of installed single glazed windows into multiple glazed windows, more particularly to an improved structure and method for affixing an additional pane of glass and a spacer element to an existing window installation so as to create a double glazed unit having a hermetically sealed, insulating airspace between the panes.

Although it has long been recognized that double glazed windows possess much greater insulating ability than single glazed windows, most installations have been provided with single glazing for the sake of economizing on construction costs. But with the rapid rise of the costs of heating and cooling buildings, this economy has proven to be false. Thus, it has become increasingly desirable to convert single glazing to double glazing, not only for improving the insulating properties, but also for the sake of the advantages attained from the addition of a tinted or reflectively coated pane. Unfortunately, removing and discarding existing windows and installing whole double glazed units in their place incurs prohibitive costs for labor and materials.

Accordingly, it is an object of this invention to provide a method and means for quickly and easily converting a single glazed window into a double glazed window by sealing an additional pane of glass to the existing installation. The present invention is specifically adapted to provide easy installation, ready adaptability to any size of window opening or frame construction, superior moisture barrier integrity, and improved structural strength.

Various attempts have been made in the prior art to provide on-site installation of secondary panes of glass, but all suffer from certain shortcomings that have discouraged their use. A typical prior art approach can be seen in U.S. Pat. No. 2,436,037 (Doney) where a rubber gasket serves as both spacer and sealing means. The rubber-to-glass seal utilized therein is a relatively poor moisture barrier, since most natural and synthetic rubbers are somewhat pervious, thus rendering the surfaces of the airspace susceptible to condensation. Rubber is also susceptible to degradation upon exposure to sunlight and weather conditions. Such an arrangement is limited to installation from the outside on relatively deep frames, a distinct disadvantage at many locations, especially on large buildings. Furthermore, sealing difficulties would be encountered at the mitered corner joints called for in Doney. Another prior art approach is shown in U.S. Pat. No. 3,299,591 (Woelk) where a strip of epoxy resin serves as both spacer and sealant. That arrangement provides only a short barrier against moisture penetration, and the epoxy resin, which is apparently required for the sake of high adhesion strength and room temperature curability, is not a reliable sealing material because of its moisture vapor transmissibility and low temperature inflexibility. In order to obtain an attractive appearance, it also appears that specialized extruding or casting equipment for the epoxy would have to be employed at the installation site. A further prior art approach is disclosed in U.S. Pat. No. 3,573,149 (Tibble et al). In that patent, a neoprene composition is melted and cured in situ to effect a seal. Again, the barrier in the path of moisture penetration is short in length, and the curable thermoplastic material required is not noted for its moisture barrier properties. Installation requires the use of specialized electrical equipment at the site and lengthy heating times. The technique is also susceptible to uneven heating which may, in turn, yield uneven sealing.

Add-on glazing devices of a different type can also be seen in the following four U.S. Patents relating to automobile windows:

| | | |
|---|---|---|
| U.S. Pat. No. | 1,777,435 | Hogelund |
| " | 1,915,098 | Kile |
| " | 1,945,742 | Hilger |
| " | 2,098,127 | Auger |

Each of these references suffers from lack of permanency and integrity of seal, which are required for acceptance in the architectural glazing field. Each employs an unprotected organic spacer which is subject to moisture penetration.

SUMMARY OF THE INVENTION

In accordance with the present invention there is provided a method which includes affixing a spacer element to the periphery of a pane of glass to be added to an installed window pane so as to provide a moisture resistant barrier and/or improved structural strength. The additional pane, with the strip and spacer attached is then sealed to the installed pane by interposing a tacky, preferably non-curing sealant material between the spacer and the installed glass and then pressing them together.

The invention also embraces a subassembled article comprising an unmounted pane of glass having a spacer element attached around the periphery which possess superior sealing and structural properties. Such subassemblies may be efficiently mass-produced at a manufacturing or central distribution facility, thus freeing the glazier from almost all assembly tasks at the site and assuring more uniform quality.

The invention further includes a novel multiple glazed window comprising a plurality of substantially parallel spaced panes, produced in accordance with the practice of the disclosed method of on-site installation, and which possesses superior sealing qualities and structural integrity.

DETAILED DESCRIPTION OF THE INVENTION

A complete understanding of the invention will be obtained from the following detailed description taken together with the drawings in which:

FIG. 9 is a fragmentary cross-sectional view, taken along lines 9—9 in FIG. 8 of a completed installation of the subassembly shown in FIG. 4 onto a previously single glazed window;

FIG. 15 is a fragmentary cross-sectional view of an alternate subassembly embodiment utilizing a rigid spacer;

FIG. 16 is a fragmentary cross-sectional view of a completed installation of the subassembly shown in FIG. 15 onto a previously single glazed window;

FIG. 17 is an exploded, fragmentary, cross-sectional view of another embodiment of the invention showing the relationship of the parts prior to assembly;

FIG. 18 is a fragmentary, cross-sectional view of a completed installation of the embodiment of FIG. 17;

Figure 1:
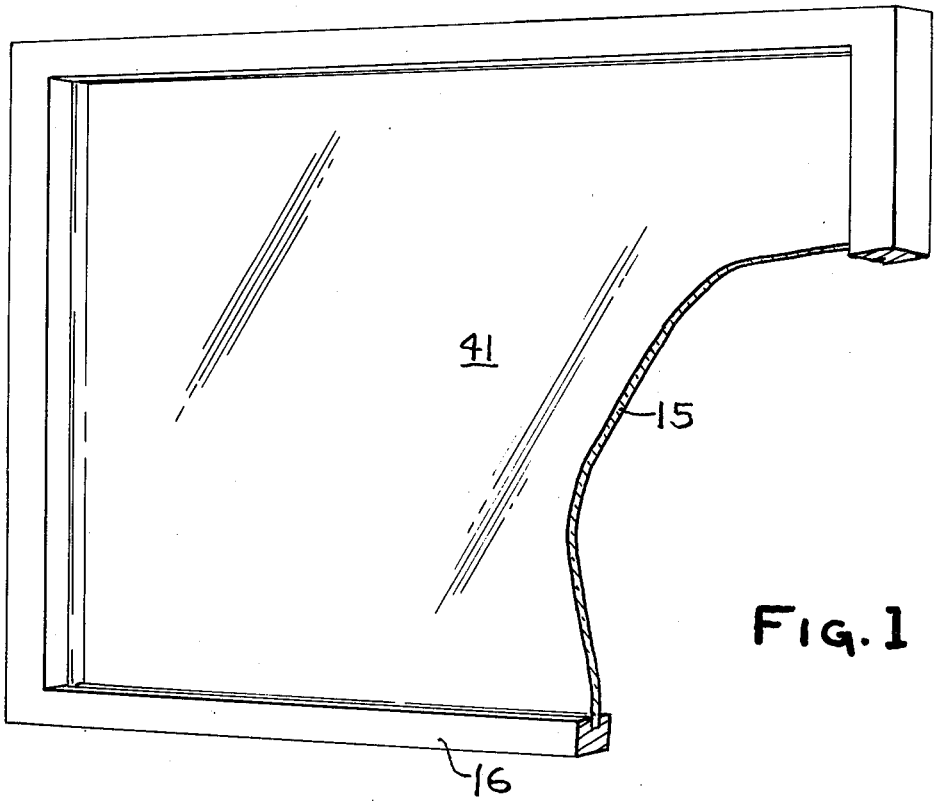
FIG. 1 is a perspective interior view, partially cut away, of a typical single glazed window installation upon which the present invention may be practiced.

Depicted in FIG. 1 is an interior view of a single glazed window unit that would typically form part of a building wall structure, the window comprising a pane of glass 15 and a frame 16. The conversion of such a window to double glazing will serve as an illustrative example of this invention.

Figure 2:
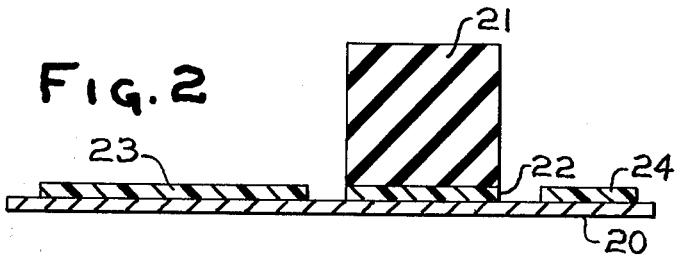
FIG. 2 is a cross-sectional view of an edge strip assembly having an organic spacer and sealant material applied to a moisture resistant ribbon in accordance with an embodiment of the present invention.

In FIG. 2, there can be seen a cross-sectional view of a preferred embodiment of an edge strip arrangement which forms the basis for the present invention. The edge strip includes as a base element a continuous ribbon of moisture resistant (essentially moisture impermeable) material 20, preferably an aluminum foil or strip having a thickness of about 8 mils. Although somewhat more susceptible to moisture penetration, various films of plastic, such as the dense polyethylenes, may be used for the ribbon 20. A continuous length of organic spacer element 21 is affixed along the length of the ribbon by means of an adhesive layer 22. Adhesive 22 may be a sealant material, but is selected with strong adhesion as the primary desideratum so as to prevent dislocation of the flexible organic spacer in the completed installation. The adhesive 22 should be rigid in the temperature range encountered in window installations, and for ease of manufacturing, it should be capable of forming an instant bond between the foil and the spacer. An adhesive that has been found suitable is USM 1311, a polyethylene copolymer sold by United States Machinery Corporation, which is applied in a hot melt form to the foil which is also heated. Such an adhesive forms an exceptionally strong bond after the adhesive has cooled and set, the 180° peel strength between the spacer and the ribbon exceeding 25 pounds per lineal inch as determined by A. S. T. M. D-903-49T.

The expressions "moisture resistant", "barrier against moisture penetration", and "hermetic seal", as used herein, refer to an ability to prevent passage of water vapor to such an extent that the subject material or structure is capable of being utilized in a multiple glazed architectural installation. To qualify for such architectural use, a material or structure should present enough of an obstacle to water vapor transmission to preclude condensation of water vapor in the interior of a multiple glazed unit at temperatures down to about 0°F. (i.e., about $1.77 \times 10^{-5}$ grams of water per cubic inch of air in the unit) and preferably lower, over a period of several years. The time period required is at least about 3 to about 5 years, but preferably is at least about 10 years, and in optimum cases is at least about 20 years. The amount of water vapor penetration depends not only on the inherent moisture vapor transmission of the material employed as the obstacle, but also on the dimensions (e.g., thickness) of the obstacle in the path of water vapor penetration. Because visual aesthetics must be considered in regard to architectural glazing, it is desirable to minimize the dimensions of the water vapor barriers, thus materials having a relatively low moisture vapor transmission are preferred. For this reason, it is generally preferred that the materials used for moisture barriers in multiple glazing have a moisture vapor transmission of less than about 15 grams (preferably less than about 6 grams) per 24 hours per square meter per mil thickness at 100°F. and 90% relative humidity as determined by A. S. T. M. E-96-66E. Desiccants are often included in multiple glazed units to adsorb moisture vapor in the airspace, and when a desiccant is employed, the requirements for moisture barriers may be relaxed by an amount corresponding to the water adsorbing capacity of the desiccant.

Referring again to FIG. 2, spacer 21 may be any solid or semisolid rubber or synthetic polymeric material which maintains sufficient rigidity under ambient temperature conditions to retain two panes of glass in substantially parallel, spaced relationship. A preferred spacer is the spacer-dehydrator disclosed in U.S. Pat. No. 3,758,996, which may be described generally as a moisture vapor transmittable matrix of a block copolymer of styrene and butadiene having interspersed therein a desiccating material. If such a spacer-dehydrator is not used, separate desiccating material is preferably affixed to or embedded in at least a portion of the spacer along its length or placed in the airspace at the time of installation at the site.

As shown in FIG. 2, a continuous band of mastic 23 is applied to ribbon 20 parallel to spacer 21. The composition and width of mastic 23 are selected so as to form a moisture resistant barrier when bonded to the glass surface, as will be set forth with more particularity hereinbelow. Mastic 23 is desirably a room temperature curable or vulcanizable material that will cold flow to form a moisture resistant seal and a resilient structural bond. Butyl-based mastics are preferred, such as the two component, room temperature curable, butyl-based mastic disclosed in U.S. Pat. No. 3,791,910 to George H. Bowser. On-site assembly is substantially expedited by providing a tacky, non-curing composition for mastic 23. A preferred non-curing mastic is disclosed in U.S. patent application Ser. No. 454,336 filed under the name of George H. Bowser on even date herewith and assigned to the assignee of the present invention. The mastic disclosed in that application has the following composition:

| (Component) | (Weight %) |
|---|---|
| polyisobutylene (viscosity average molecular weight 75,000 – 100,000) | 15–50 |
| polyisobutylene (viscosity average molecular weight 8,000 – 10,000) | 10–45 |
| carbon black | 10–45 |
| silica pigment | 5–15 |
| zirconium orthosilicate | 5–15 |
| polybutene | 20–50 |
| zinc oxide | 0–5 |
| gamma-glycidoxy-propyltrimethoxysilane | 0–5 |

Figure 3:
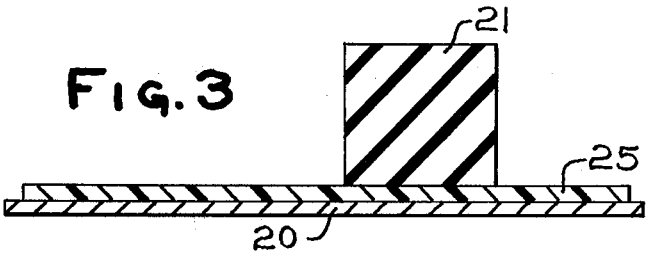
FIG. 3 is a cross-sectional view of an alternate embodiment of the edge strip assembly.

On an extending portion of ribbon 20, on the opposite side of spacer 21 from mastic 23, there is provided a band of adhesive 24. The primary function of adhesive 24 is to hold the extending portion of ribbon 20 against the side of spacer 21 when the ribbon is folded in accordance with assembly procedures to be set forth below. Thus, adhesive 24 may be merely a narrow bead or discontinuous spots of adhesive material. In most cases, however, band 24 may be the same compound as mastic 23. As an alternate embodiment for the edge strip, there may be a single mastic-adhesive layer 25 applied to substantially the entire surface of one side of ribbon 20 as shown in FIG. 3. Although the FIG. 3 embodiment lacks the advantages of using the hot-melt adhesive 22 of the FIG. 2 embodiment, it possesses sealing advantages in that the organic spacer 21 may be protected by a continuous layer of moisture resistant mastic. Mastic 25 may consist of the compositions disclosed in U.S. Pat. No. 3,791,910 or the aforementioned copending application of George H. Bowser.

Figure 4:
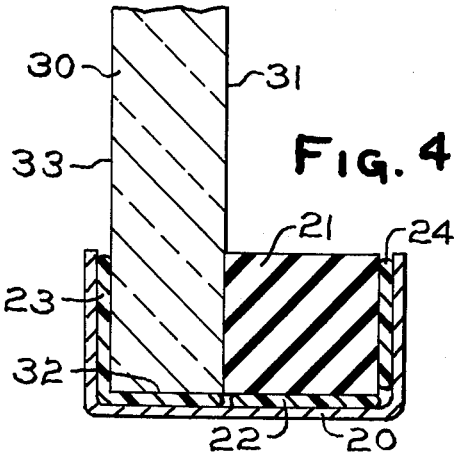
FIG. 4 is a fragmentary cross-sectional view of the edge strip shown in FIG. 2 applied to the periphery of a pane of glass to form a subassembly.

Turning now to FIG. 4, there is shown the edge strip of FIG. 2 applied to a rigid transparent pane 30, which is the additional pane to be added to the existing installation. Pane 30 may be glass or plastic, and may be tinted or reflectively coated in accordance with known methods in the art. When the pane 30 is coated, especially when the coatings are subject to deterioration, the coating should be on inner surface 31, which will ultimately be exposed to only a sealed airspace. Care must be taken to clean all oil, dirt, and other contaminants from the pane using appropriate solvents. Glass panes may also have their edges lightly seamed to reduce lacerative risk to personnel and to prevent tearing of ribbon 20.

As shown in FIG 4, the spacer 21 is placed with one side in close contact with surface 31 of the pane. Sealant or adhesive may optionally be included between the spacer and the pane for extra sealing or extra strength but is usually not needed. The extending portion of ribbon 20, which carries mastic 23, is folded around the edge of pane 30 and is pressed against the pane so as to flow the mastic and create a seal between the ribbon and the peripheral edge 32 of the pane as well as to the margin of major surface 33. The other extending portion of the ribbon, carrying adhesive or mastic 24, is folded against and adhered to the side of spacer 21 which is adjacent to the side already adhered to the ribbon. Generally, the attachment of the edge strip assembly is started at one corner of the pane and is continued about the entire periphery of the pane with a single length of the edge strip. At corners, the spacer may be notched to produce mitered joints. Where the ends meet, the edge strip may be trimmed to butt the ends together and sealant added to the joint, or the spacer may be cut from an overlapping length of the edge strip and the extra length of ribbon 20 sealed across and beyond the joint.

Several important advantages for the presence of ribbon 20 can be seen at this point. First, a flexible organic spacer is given structural rigidity by reason of its attachment to the ribbon. Also, a spacer, flexible or rigid, is thereby provided with a stronger structural attachment to pane 30. Another important advantage is that the presence of ribbon 20 permits the use of a greater width of moisture resistant material (sealant 23) for sealing the interface between the spacer and pane 30, and because the moisture resistant material is deployed between the ribbon and surfaces of pane 30 rather than between the spacer and the pane, it enables one to exert greater and more uniform pressure on the material to form a good seal than could be done by attempting to press a flexible organic spacer itself onto the pane. Furthermore, the ribbon provides a laterally and longitudinally continuous, moisture resistant barrier in the path of moisture penetration into a pervious organic spacer.

Figure 5:
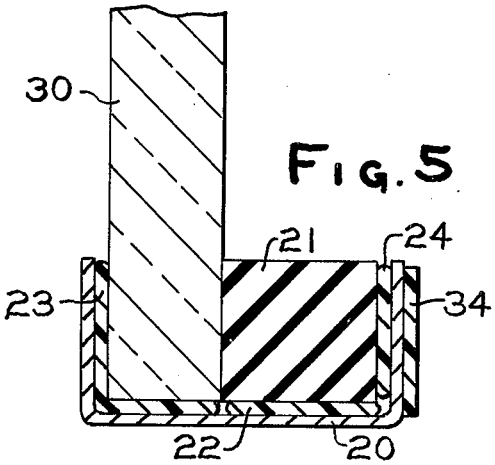
FIG. 5 is a fragmentary cross-sectional view of the subassembly shown in FIG. 4 with sealant material applied thereto.

Optionally, a band of mastic 34 may be applied along the exposed surface of the portion or ribbon 20 which extends around the spacer and is parallel to the major surfaces of pane 30 as shown in FIG. 5. Mastic 34 should be tacky and non-curing, preferably the butyl-based composition described above in connection with mastic 23, and may be conveniently supplied in strips on release paper. The release paper may be pressed in place to flow the mastic and to effect a seal and then peeled from the mastic. Mastic layer 34 should cover substantially all of the surface of the aforesaid portion of the ribbon. The addition of mastic 34 may be omitted without seriously affecting performance of the unit, but its presence has been found to result in the formation of a superior seal with a minimum amount of applied pressure.

Figure 6:
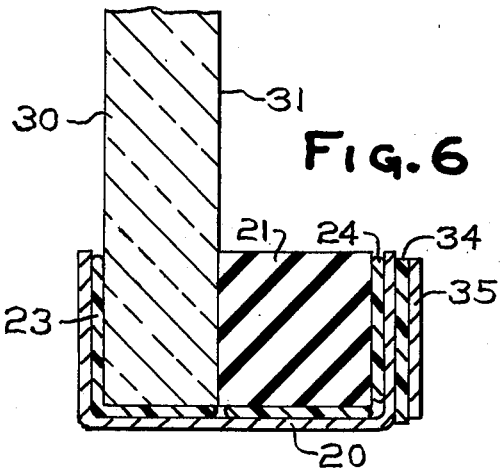
FIG. 6 is a cross-sectional view of the subassembly shown in FIG. 5 in a packaged form for handling and shipping.
Figure 7:
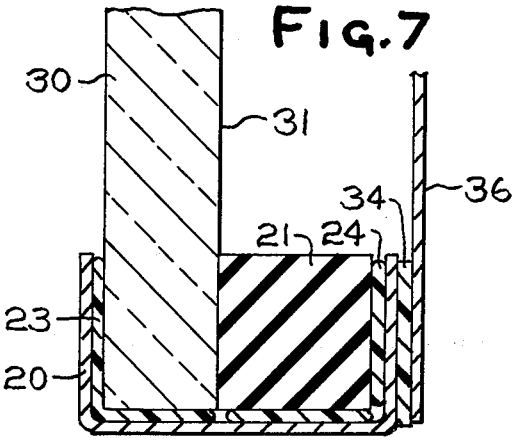
FIG. 7 is a cross-sectional view of the subassembly shown in FIG. 5 in an alternate packaged form.

The subassembly shown in FIG. 5 is ready for mounting onto the existing glazing. The preceding fabrication of the subassembly may take place at a central location and the subassemblies shipped to the job site, or the fabrication may be performed at the site. When the subassemblies are shipped in prefabricated form it is desirable to protect mastic 34 such as by retaining release paper 35 thereon as shown in FIG. 6, or by providing a strippable overlay of sheet material 36 (FIG. 7) over the entire open face of the subassembly. Overlay 36 not only protects mastic 34 but also maintains the cleanliness of the inner surface 31 of pane 30 and, if the overlay is a relatively impervious material, preserves the desiccant that may be carried by the spacer and protects the inner surface from moisture.

Figure 8:
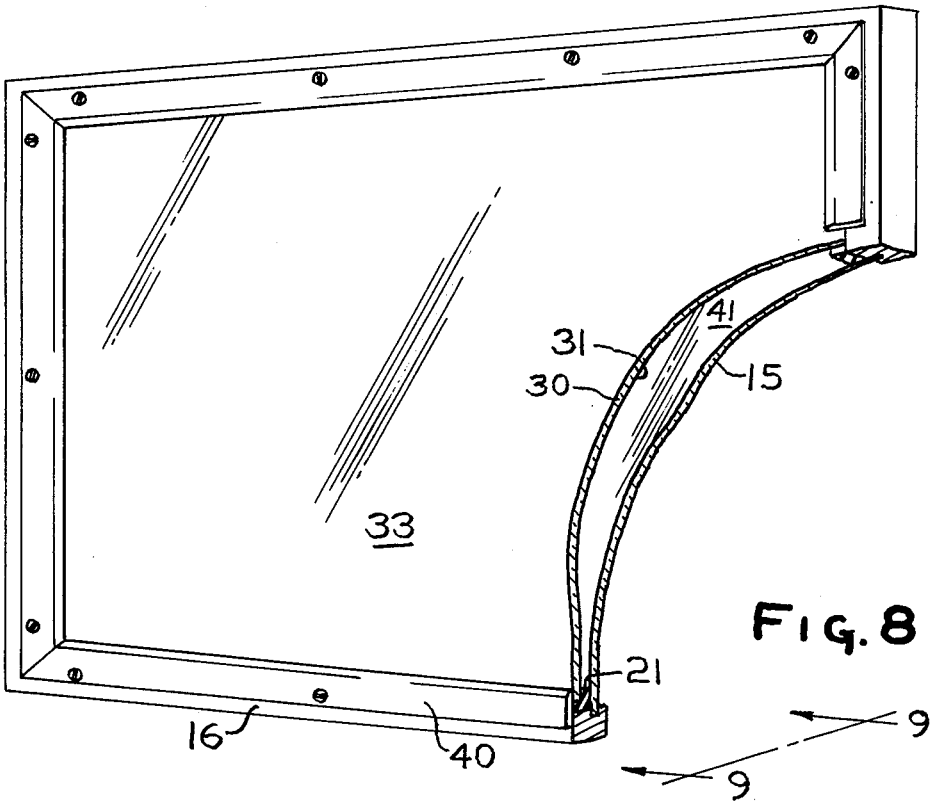
FIG. 8 is a perspective interior view, partially broken away, of the window structure shown in FIG. 1 after conversion to double glazing in accordance with one embodiment of the present invention.

In FIG. 8, the subassembly of FIG. 5 is shown installed onto the interior of the existing single glazed window depicted in FIG. 1. Interior installation is advantageous for the sake of easy accessibility, but the present invention can also be used for adding glazing on the exterior side. Exterior installation may even be preferred in some cases because of particular sash configurations or for better reflectivity when reflectively coated glass is being added. Optional decorative trim 40 is also shown in FIG. 8 applied around the periphery of the window. Details of the installation may be seen in FIG. 9, which is a cross-sectional view of the edge portion of the window, taken along lines 9—9 in FIG. 8.

When installing the subassembly to surface 41 of existing pane 15, that surface and the adjacent areas of frame 16 must be thoroughly cleaned. A layer of moisture resistant mastic 42 is then applied around the periphery of pane 15 along a path corresponding generally to the outline of spacer 21 on the subassembly as shown in FIG. 9. The width of the layer 42 may be wide enough to extend at least slightly above and below the outline of the area that spacer 21 will contact on surface 41 so as to provide a maximum area of contact and some margin for error. Extending mastic 42 all the way to frame 16 will provide an even greater margin for error and expedite alignment of mastic 42 on surface 41. Mastic 42 is tacky, preferably the non-curing, butyl-based sealant described above in reference to mastic 23, and may be carried on release paper which is pressed against the pane 15 and then peeled off. The combined thicknesses of mastic 34 and mastic 42 should be sufficient to assure a flowing of the mastic material when they are pressed together, thus eliminating voids and effecting a continous hermetic seal. It has been found satisfactory to provide mastics 34 and 42 each with thickness of about one-sixteenth of an inch, or, when mastic 34 is not employed, to provide mastic 42 alone with a thickness of about one-eighth of an inch.

The subassembly is next moved into position and aligned with mastic 42. Setting blocks of a resilient material such as neoprene are inserted at spaced intervals across the bottom edge of the subassemby in the space between the subassembly and frame 16 in accordance with conventional glazing techniques. The subassembly is then pressed against pane 15 to effect a seal with mastic 42. Pressure may be applied by clamp means carried by the glass holding equipment, or by special leverage means coacting with the frame or wall structure. Another technique is to impose a vacuum in the newly-created air space 43 for a sufficient time to permit the mastic to flow and seal. Both vacuum and mechanical means may be used simultaneously to obtain the best results.

Figure 10:
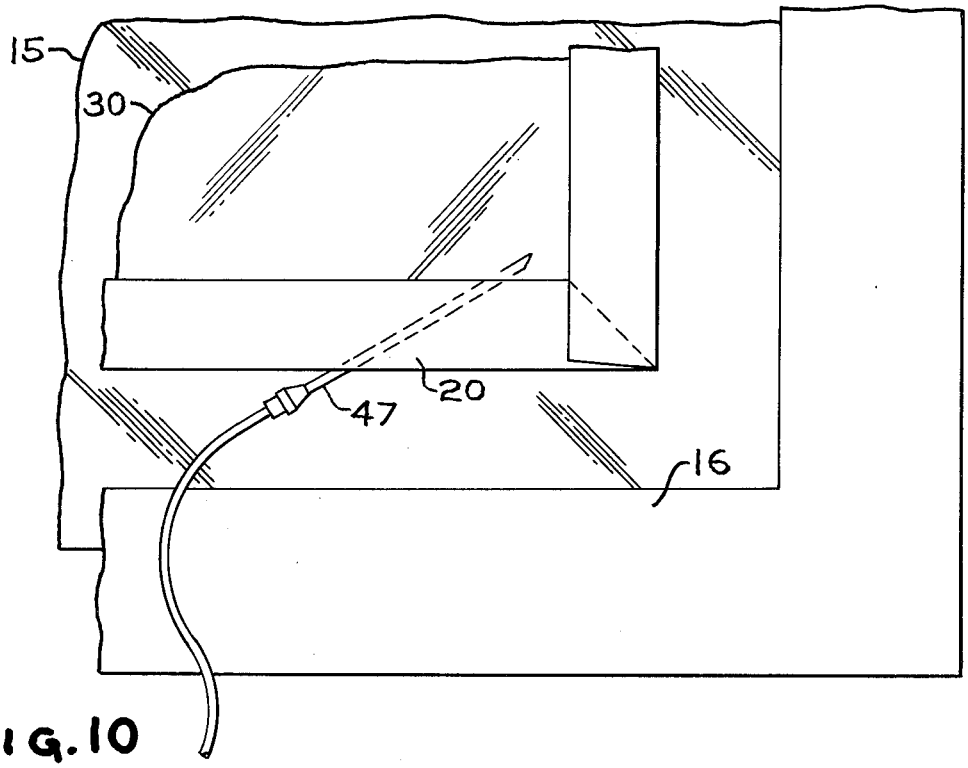
FIG. 10 is a fragmentary elevation of a subassembly mounted onto an existing glazing installation showing one means for vacuuming the airspace.
Figure 11:
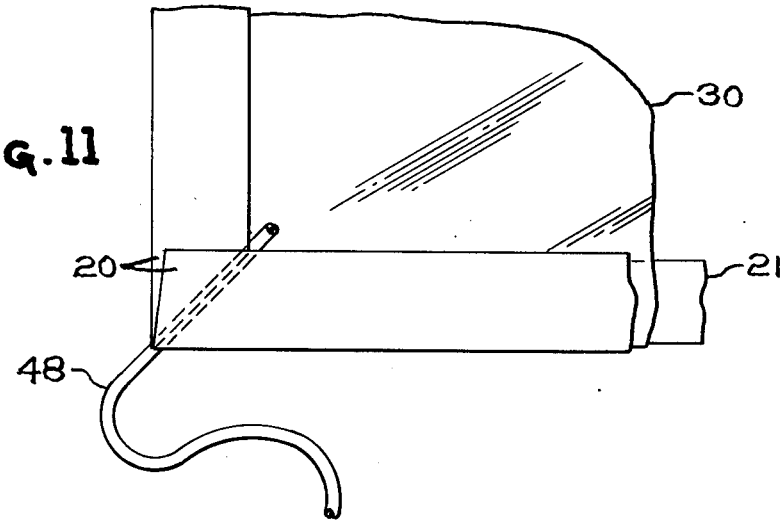
FIG. 11 is a fragmentary elevation of a subassembly having a vacuuming tube placed in a joint.

The vacuum may be attained by inserting a hollow needle 47 through ribbon 20 and spacer 21 as shown in FIG. 10 if space permits, and afterwards sealing the puncture. In most cases, however, it is preferable to seal a length of flexible, small-gauge plastic tubing 48 into the joint of the edge strip during fabrication of the subassembly as shown in FIG. 11 so as to communicate the air space with the exterior. After the vacuum has been drawn by way of the tubing and held for a period of time, the vacuum is released and the tubing sealed or the tube removed and the aperture sealed. In some cases, it is desirable to include a breather tube in double glazed units as disclosed in U.S. Pat. No. 3,771,276. In such cases, the breather tube may be used to pull the vacuum in the airspace.

At this point in the assembling procedure, the resulting double glazed unit is essentially complete. As an extra precaution, it may be desirable to extrude a sealant 44 into the gap left around the perimeter of the unit. Resilient butyl-, polysulfide-, or silicone-based sealants may be used for this purpose. Such a sealant may also be appropriately filled or colored so as to serve as a decorative trim. For the sake of appearance, it may also be desired to fasten metal, plastic, or wooden trim 40 to frame 16. Although the ribbon 20 and the various mastic layers provide adequate strength in themselves for holding the resulting double glazed unit together, the trim 40 may also be adapted to provide a secondary restraining force.

Figure 12:
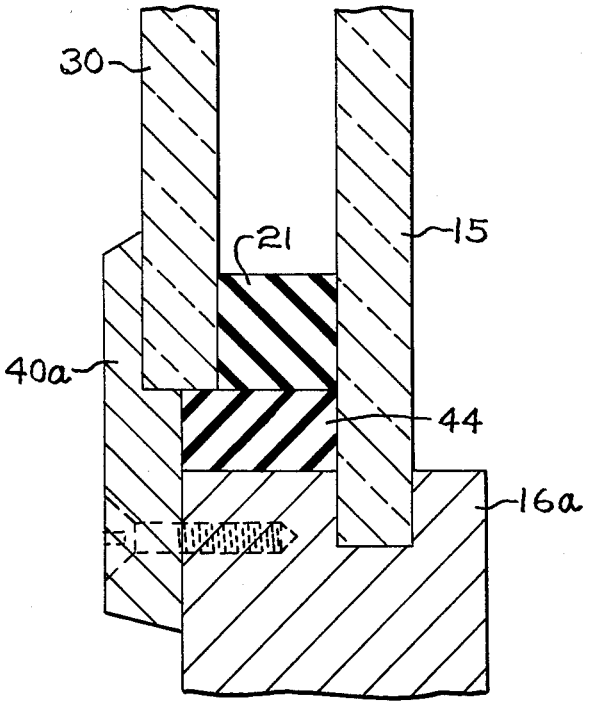
FIG. 12 is a schematic, fragmentary, cross-sectional view of an alternate framing treatment for a narrow window frame in conjunction with the present invention.
Figure 13:
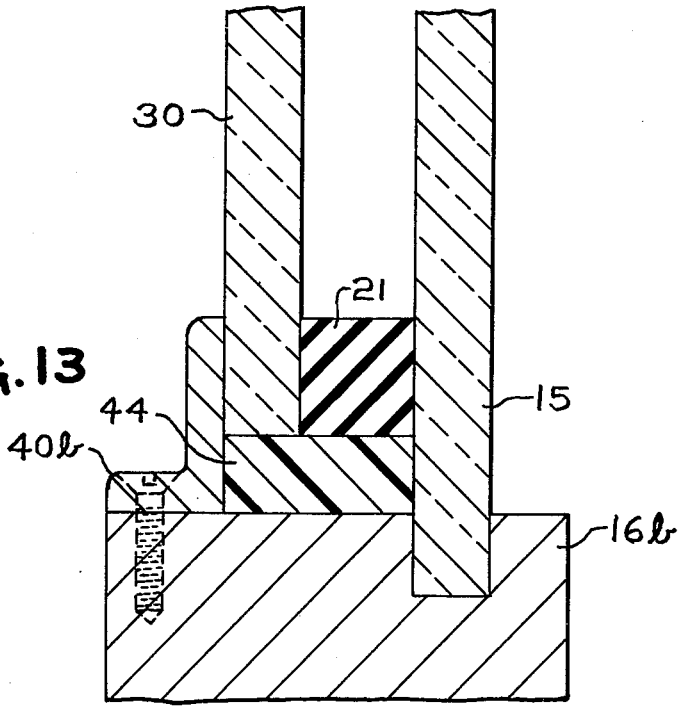
FIG. 13 is a schematic, fragmentary, cross-sectional view of an alternate framing treatment for a wide window frame in conjunction with the present invention.

The add-on multiple glazing technique of the present invention can be adapted for use with virtually any window frame configuration. Two such adaptations are shown in FIGS. 12 and 13. FIG. 12 depicts schematically a completed installation on a relatively narrow frame **16*a* utilizing a modified trim member 40*a*. FIG. 13 is a schematic representation of a completed installation involving a relatively wide frame 16*b* and modified trim 40*b***. In cases where extremely narrow frames are encountered, it may be necessary to fasten additional strips of material to the frames to extend the width of the frames.

Figure 14:
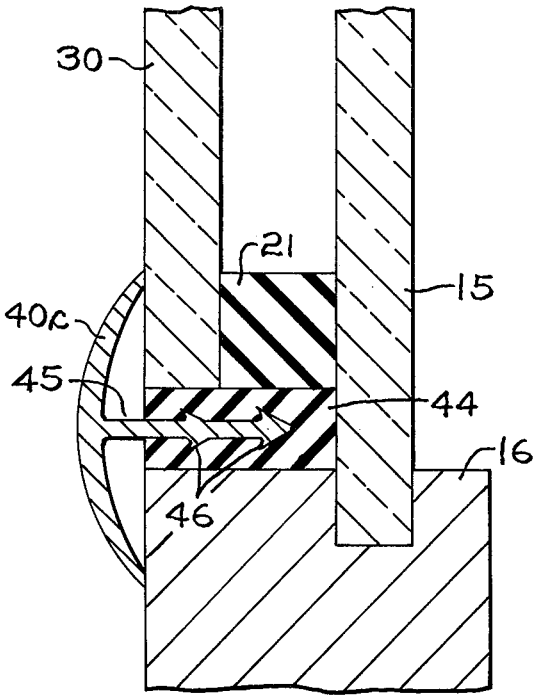
FIG. 14 is a schematic, fragmentary, cross-sectional view of an alternate framing treatment using a nail-less, screw-less trim insert in conjunction with the present invention.

Another modification, shown in FIG. 14 in connection with a schematic illustration of a completed installation, is the use of a nail-less, screw-less trim member **40*c*. Such a trim member is provided with an extending flange 45 which carries a plurality of barbs 46. The trim is installed by merely pressing the flange 45 into the sealant 44**, where the outwardly oriented barbs will engage the sealant and resist removal.

Heretofore the description of the invention has related to the use of organic spacers, but the invention also provides certain advantages when metal spacers are employed. In FIG. 15, there is shown a subassembly embodiment which includes a rigid spacer 50, preferably made of metal, containing desiccant 51, and provided with an opening 52. Details of a preferred metal spacer are disclosed in U.S. Pat. No. 2,684,266. Since metal spacers generally require welding at the corner joints, the unit shown in FIG. 15 is contemplated as being primarily a factor fabricated item. As such, the mastic materials employed may be selected from any of the moisture resistant sealant compounds previously discussed, preferably the butyl-based sealants. Since the metal spacer forms a rigid structure, the mastics may be chosen primarily for their sealing characteristics rather than their structural strength properties. Spacer 50 may be sealed to the additional pane 15 by means of sealant 53 so as to form a primary hermetic seal. A moisture resistant ribbon 54, (preferably metallic) coated with a sealant 55, is sealed to the outer surface of the spacer and folded around the edge of the pane 30 so as to form a moisture resistant seal with its peripheral edge surface 32 and with the margin of major surface 33. The secondary seal thus formed and the primary seal at 53 together provide a superior moisture barrier. An adequate seal can be achieved with sealant 55 alone, thus sealant 53 could be eliminated if desired. Since a metal spacer such as spacer 50 is essentially moisture impervious, ribbon 54 need not be extended over the adjacent surface of the spacer as done in the organic spacer embodiments. The ribbon does serve another function, however, that being reinforcement of the attachment of the spacer to the pane 30. For this reason, it may be advantageous to likewise provide a ribbon of sufficient width to enable a portion to be folded around a corner of the spacer and to be adhered to the adjacent front surface of the spacer in the case of metal spacers as well.

A completed installation of the subassembly of FIG. 15 onto a single glazed window may be seen in FIG. 16. Mounting techniques are similar to those described above in connection with the organic spacer embodiments. Mastic layer 56 is preferably the same tacky, non-curing, butyl-based material previously described, and is applied to the glass 15 in the same manner as mastic 42 in the previous embodiments. Prior to mounting, additional mastic may be applied to the exposed surface of spacer 50 which is parallel to the major surfaces of pane 30 in order to provide a mastic-to-mastic bond with layer 56.

The techniques of the present invention may also be applied to a method of attaching a metal spacer to an additional pane which may be carried out at the job site without the need for welding. Referring now to FIG. 17, there is shown an unwelded segment of a metal spacer 60 having desiccant 61 and an opening 62. A separate segment is provided for each side of the unit, and each segment is individually affixed to additional pane 30 by means of adhesive or sealant layer 63 which is preferably tacky so as to form an instant bond. A continuous ribbon 64 of moisture resistant material (essentially moisture impermeable), preferably aluminum foil, having a layer of tacky, non-curing, moisture resistant sealant 65 thereon, is then applied to the edge of the unit, folded around the edge of pane 30 and a corner of spacer 60 and pressed to flow the sealant and form a seal. Because the ribbon is passed continuously around the corners of the unit, a good seal can be attained without requiring the joints of the metal spacer to be welded. The ends of the ribbon 64 should be overlapped to effect a seal.

The subassembly of FIG. 17 is installed onto the existing glazing 15 as shown in FIG. 18 with the same mounting procedures as set forth above, the critical seal being effected by a tacky, non-curing mastic 66 that is similar to or the same as mastic 56.

Although the preceding embodiments are preferred because of the combined structural and sealing advantages of the peripheral ribbons employed on the subassemblies, subassemblies suitable for architectural use can be produced without such a ribbon. Examples of such embodiments may be seen in FIGS. 19 through 24.

Figure 19:
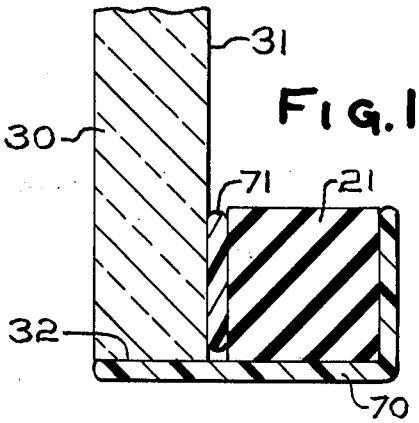
FIG. 19 is a fragmentary cross-sectional view of another subassembly embodiment which has a moisture barrier of sealants only.
Figure 20:
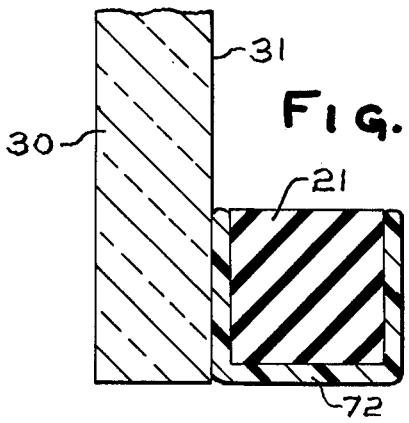
FIGS. 20, 21 and 22 are fragmentary cross-sectional views of variations of the subassembly embodiment shown in FIG. 19.
Figure 21:
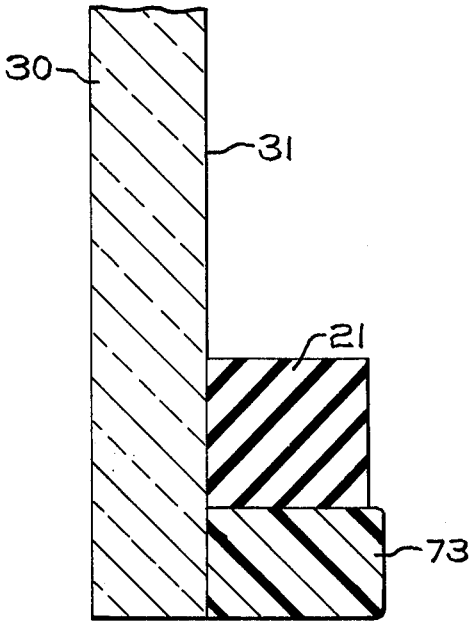
Figure 22:
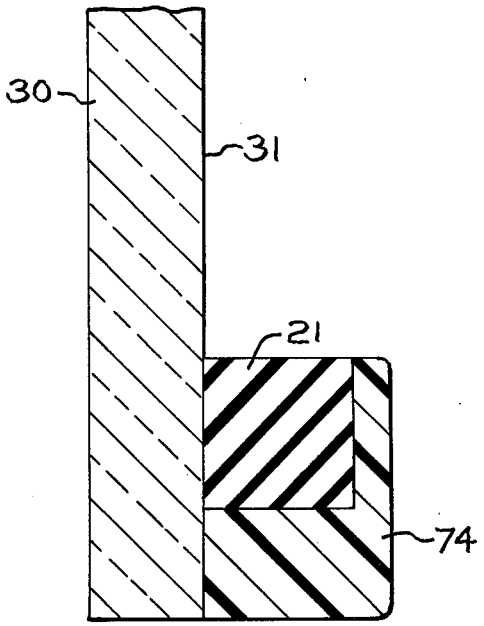

The subassembly shown in FIG. 19 is essentially the same as the embodiment of FIG. 4, except that the ribbon has been omitted, and in lieu thereof moisture resistance is provided by sealant layer 70 and structural strength is provided by adhesive layer 71. A barrier for resisting moisture penetration through organic spacer 21 or between the spacer and pane 30 is provided by selecting appropriate materials and thicknesses for sealant 70. The preferred material for sealant 70, as well as for the sealants in FIGS. 20 through 22, is the previously described tacky, non-curing, butyl-based composition. When such a tacky sealant is employed, it would be desirable to protect the exposed surfaces of the sealants shown in FIGS. 19 through 22 during shipping and storage with suitable strips of release paper.

Adhesive 71 may be a moisture resistant material as well, or, as shown in FIG. 20, a continuous layer of moisture resistant sealant 72 may extend around three sides of the spacer, thereby serving as both moisture barrier and structural joining means.

Figure 25:
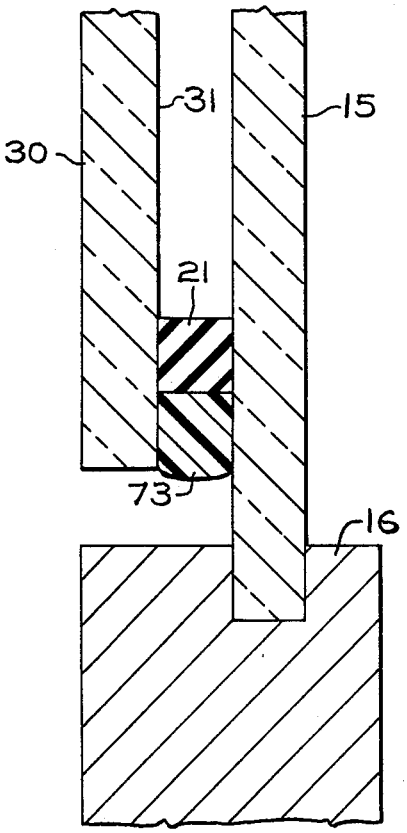
FIG. 25 is a fragmentary cross-sectional view of a completed installation of the subassembly shown in FIG. 21 onto a previously single glazed window.

FIG. 21 depicts a two-layered approach, where an extra thick body of sealant 73 serves as a moisture barrier. This approach requires moisture to penetrate an exceptionally great thickness of moisture resistant sealant in the direction parallel to the major surfaces of pane 30 before it can enter organic spacer 21. The body of sealant 73 protrudes beyond the spacer so as to engage and form a seal with an installed pane to which the subassembly is to be mounted. A greater area for sealing a subassembly to an installed pane may be provided by employing an extended body of sealant 74 as shown in FIG. 22. A completed installation of the subassembly of FIG. 21 onto a previously single glazed window is shown in FIG. 25.

Figure 24:
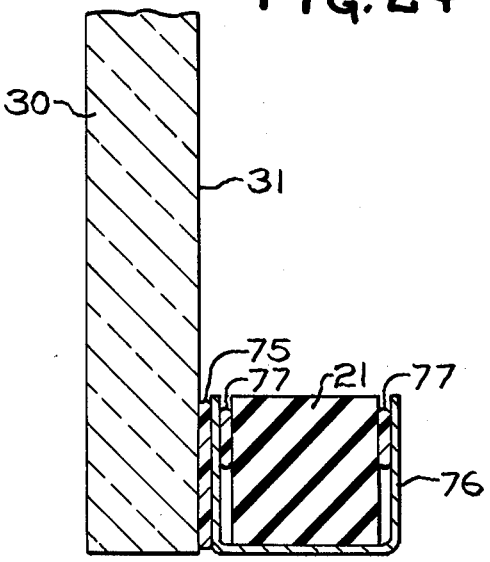
FIG. 24 is a fragmentary cross-sectional view of yet another subassembly embodiment which provides an organic spacer with a moisture resistant wrapper.
Figure 23:
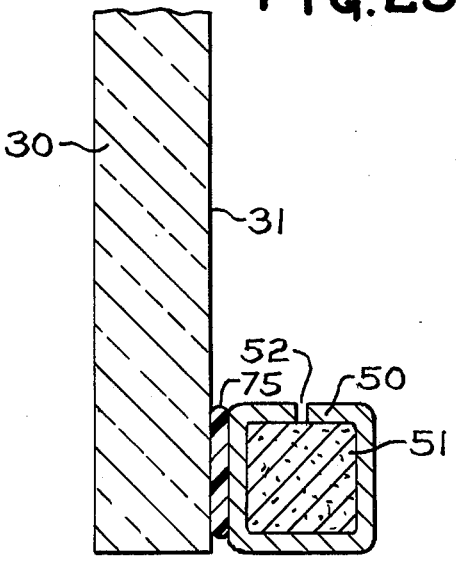
FIG. 23 is a fragmentary cross-sectional view of a simplified subassembly embodiment employing a metal spacer.

Since a spacer made of metal is itself moisture impervious, the need for a moisture resistant seal in an embodiment employing a metal spacer is primarily to resist moisture penetration around the spacer. Thus, in FIG. 23, a metal spacer 50, as described in connection with the FIG. 15 embodiment, is sealed to pane 30 with a layer of moisture resistant material 75. The metal spacer and the layer 75 together present a moisture resistant barrier in the path of moisture penetration in the direction parallel to the major surfaces of pane 30. The same approach may be utilized with a relatively moisture transmittable organic spacer if the spacer is first made moisture resistant by wrapping it with a moisture resistant tape 76 as shown in FIG. 24. The tape is held in place on spacer 21 with spots or beads of adhesive 77. Tape 76 is preferably an essentially moisture impermeable material such as an aluminum foil or strip.

The mounting procedures and the general configurations of the completed multiple glazed installations for the subassembly embodiments of FIGS. 19 through 24 are essentially the same as set forth above in connection with the FIG. 9 and FIG. 16 embodiments.

Figure 26:
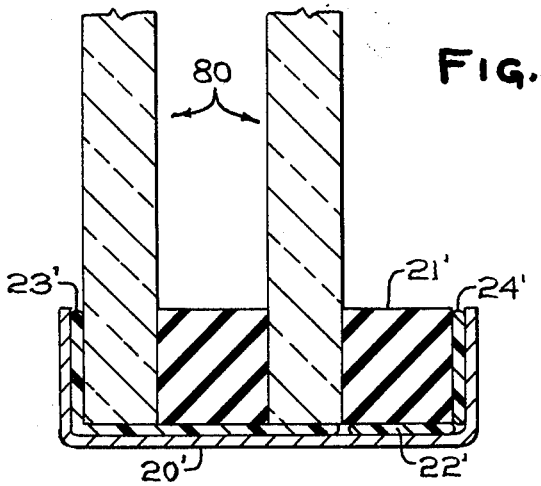
FIGS. 26, 27 and 28 are fragmentary cross-sectional views of subassemblies corresponding to FIGS. 4, 15, and 21, respectively, based on double glazed units.
Figure 27:
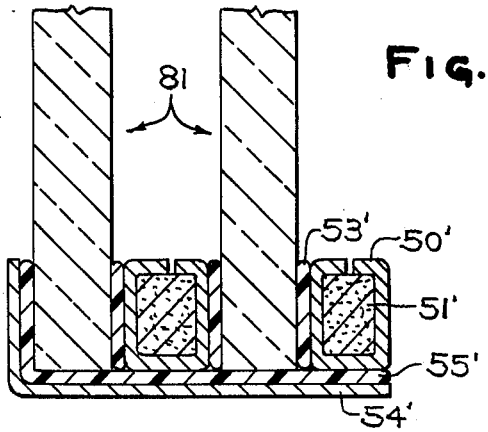
Figure 28:
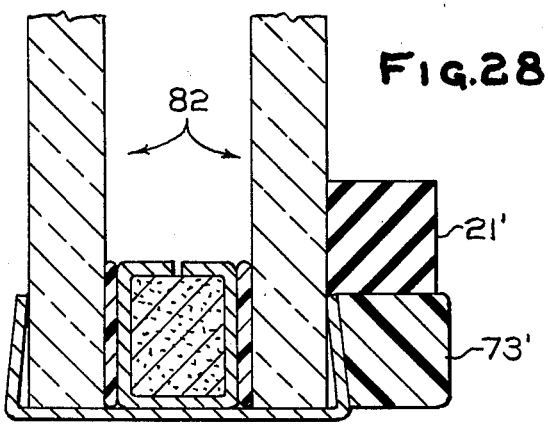

It should be apparent that in any of the embodiments disclosed herein a second subassembly may be installed onto a previously mounted subassembly so as to create a triple glazed installation. Alternatively, one subassembly itself may include two or more spaced panes as shown in FIGS. 26, 27 and 28. There, the subassembly configurations correspond to those in FIGS. 4, 15 and 21, respectively, with like parts indicated by primed numerals, but instead of a single pane of glass 31, the subassemblies are based on any conventional multiple glazed unit such as 80, 81 or 82.

Each of the sealants, mastics, or adhesives employed in conjunction with this invention is preferably highly moisture resistant, i.e., characterized by low moisture vapor permeability so as to effect good moisture barriers and hermetic seals. In addition, they are also preferably characterized by excellent flexibilty; cohesive and adhesive bonding; and tear, shear, peel, and tensile strength over a relatively wide range of expected operating temperatures, including temperatures from −60° to 140°F. Furthermore, they should be essentially inert and unaffected by chemicals, e.g., cleaning solutions, air borne pollutants or the like, with which they may normally be expected to come into contact.

It should be understood, however, that in certain instances related to the location or use of the sealants, mastics, or adhesives in the structures disclosed, one or more of the above characteristics or properties may be of more dominant importance than another or others and accordingly, the choice of mastic materials used may vary substantially. For example, moisture resistance is not a dominant requirement for mastic 22 in the subassembly of FIG. 2 because ribbon 20 in conjunction with the other mastics can provide the desired protection against moisture penetration during shipping, storage, or after final installation to form a multiple glazed window.

Although the present invention has been described with particular reference to the specific details of certain embodiments thereof, it is not intended that such details shall be regarded as limitations upon the scope of the invention except insofar as included in the accompanying claims.

We claim:

1. An architectural glazing unit for converting installed glazing to multiple glazing, comprising:

no more than one transparent pane;

an elongated spacer element adjoining marginal portions of a first major surface of said pane around the perimeter of said pane, each longitudinal portion of said spacer element having a first surface and a second surface on opposite sides thereof, wherein said first surface faces said marginal portions of said pane in adjoining relationship thereto, and said second surface faces outwardly, away from said marginal portions of said pane;

a ribbon of essentially moisture vapor impervious material extending around the perimeter of the unit adhered to said second surface of said spacer element and overlying peripheral edge surface portions of said pane; and moisture-resistant sealant interposed between said ribbon and edge surface portions of said pane so as to provide adhesion and a hermetic seal therebetween.

2. The glazing unit of claim 1 wherein said spacer element is comprised of a flexible, moisture vapor transmittable, polymeric material.

3. The glazing unit of claim 2 wherein a quantity of desiccant is included within said spacer element.

4. The glazing unit of claim 2 wherein said ribbon is comprised of flexible metallic material.

5. The glazing unit of claim 2 wherein said ribbon is adhered to and sealed to peripheral edge surface portions of said pane and to marginal portions of a second major surface to said pane.

6. The glazing unit of claim 2 wherein said sealant is comprised of a polymeric composition having a moisture vapor transmittance of less than about 15 grams of water per 24 hours per square meter for 1 mil thickness.

7. The glazing unit of claim 2 wherein said first surface of said spacer element is in direct, non-adhering contact with said marginal portions of said first major surface of said pane.

8. The glazing unit of claim 1 wherein said spacer element includes a rigid structure formed from essentially moisture vapor impervious material.

9. The glazing unit of claim 8 wherein said spacer element contains a quantity of desiccant.

10. The glazing unit of claim 8 wherein said ribbon is comprised of flexible material and is essentially moisture vapor impervious.

11. The glazing unit of claim 8 wherein said moisture resistant ribbon is adhered to and sealed to peripheral edge surface portions of said pane and to marginal portions of a second major surface of said pane.

12. The glazing unit of claim 8 wherein said sealant is comprised of a polymeric composition having a moisture vapor transmittance of less than about 15 grams of water per 24 hours per square meter for one mil thickness.

13. The glazing unit of claim 8 wherein said first surface of said spacer element is adhered to said marginal portions of said first major surface of said pane by means of a layer of adhesive interposed therebetween.

14. The glazing unit of claim 8 wherein said spacer element is comprised of a plurality of separate segments, each segment being affixed along one margin of said pane.

15. An architectural glazing unit for converting installed glazing to multiple glazing, comprising:

no more than one transparent pane;

an elongated, rigid spacer element formed from essentially moisture vapor impervious material adjoining marginal portions of a first major surface of said pane around the perimeter of said pane, each longitudinal portion of said spacer element having a first surface and a second surface, wherein said first surface faces said marginal portions of said pane in adjoining relationship thereto, and said second surface faces peripherally outward, away from the central region of said first major surface;

a ribbon of essentially moisture vapor impervious material extending around the perimeter of the unit, overlying said second surface of said spacer element and peripheral edge surface portions of said pane; and moisture-resistant sealant interposed between said ribbon and said second surface of said spacer element and edge surface portions of said pane so as to provide a resilient structural bond and a hermetic seal therebetween.

16. The glazing unit of claim 15 wherein an additionally extended width of said ribbon is adhered to and sealed to marginal portions of a second major surface of said pane.

17. The glazing unit of claim 16 wherein said ribbon is comprised of flexible metallic material, and said sealant is a polymeric composition having a moisture vapor transmittance of less than 15 grams per 24 hours per square meter for one mil thickness.

18. The glazing unit of claim 17 wherein said spacer element is formed from metal and contains a quantity of desiccant.

19. The glazing unit of claim 17 wherein said first surface of said spacer element is adhered to said marginal portions of said first major surface of said pane by means of a layer of adhesive interposed therebetween.

20. An architectural glazing unit for converting installed glazing to multiple glazing, comprising:

no more than one transparent pane;

a spacer element adjoining marginal portions of a major surface of said pane around the perimeter of said pane and spaced from the peripheral edges of said pane; and a body of at least partially uncured polymeric sealant adhered to said major surface between said spacer element and the peripheral edges of said pane around the perimeter of said pane, said sealant having a dimension normal to said major surface greater than that of said spacer element, said sealant having a moisture vapor transmittance of less than about 15 grams of water per 24 hours per square meter for one mil thickness and which, at room temperature, is coherent and tacky but flowable under pressure.

21. The glazing unit of claim 20 wherein said spacer element is comprised of a flexible moisture vapor transmittable, polymeric material.

22. The glazing unit of claim 20 wherein said spacer element is rigid and is formed from metal.

23. An architectural glazing unit for converting installed glazing to multiple glazing, comprising:

a multiple glazed unit having a plurality of transparent panes with an enclosed airspace therebetween;

an elongated spacer element adjoining marginal portions of a major surface of said glazing unit outside said airspace around the perimeter of said multiple glazed unit, each longitudinal portion of said spacer element having a first surface and a second surface on opposite sides thereof, wherein said first surface faces said marginal portions of said major surface in adjoining relationship thereto, and said second surface faces outwardly, away from said marginal portions of said major surface;

a ribbon of essentially moisture vapor impervious material extending around the perimeter of said glazing unit adhered to said second surface of said spacer element and overlying peripheral edge surface portions of said glazing unit; and moisture-resistant sealant interposed between said ribbon and edge surface portions of said glazing unit so as to provide adhesion and a hermetic seal therebetween.

24. An architectural glazing unit for converting installed glazing to multiple glazing, comprising:

a multiple glazed unit having a plurality of transparent panes with an enclosed airspace therebetween;

an elongated, rigid spacer element formed from essentially moisture vapor impervious material adjoining marginal portions of a first major surface of said glazing unit outside said airspace around the perimeter of said multiple glazed unit, each longitudinal portion of said spacer element having a first surface and a second surface, wherein said first surface faces said marginal portions of said multiple glazed unit in adjoining relationship thereto, and said second surface faces peripherally outward away from the central region of said major surface;

a ribbon of essentially moisture vapor impervious material extending around the perimeter of the multiple glazed unit, overlying said second surface of said spacer element and peripheral edge surface portions of said multiple glazed unit; and moisture-resistant sealant interposed between said ribbon and said second surface of said spacer element and edge surface portions of said multiple glazed unit so as to provide adhesion and a hermetic seal therebetween.

25. An architectural glazing unit for converting installed glazing to multiple glazing comprising:

a multiple glazed unit having a plurality of transparent panes with an enclosed airspace therebetween;

a spacer element adjoining marginal portions of a major surface of said multiple glazed unit outside said airspace around the perimeter of said multiple glazed unit and spaced from the peripheral edges of said multiple glazed unit; and a body of at least partially uncured polymeric sealant adhered to said major surface between said spacer element and the peripheral edges of said multiple glazed unit around the perimeter of said multiple glazed unit, said sealant having a dimension normal to said major surface greater than that of said spacer element, said sealant having a dimension normal to said major surface greater than than of said spacer element, said sealant having a moisture vapor transmittance of less than about 15 grams of water per 24 hours per square meter for one mil thickness and which, at room temperature, is coherent and tacky but flowable under pressure.

26. A multiple glazed installation comprising:

a building wall having an opening defined by a frame member;

an installed transparent pane having its peripheral edges retained in said frame member;

an added transparent pane overlying said installed pane within the outline of said frame member, in generally parallel, spaced relation to said installed pane;

an elongated spacer element disposed between opposing major surfaces of said panes, adjoining marginal portions of the opposed major surface of said added pane around the perimeter of said added pane so as to define an enclosed space between said panes, each longitudinal portion of said spacer element having a first surface facing sad added pane and a second surface facing said installed pane;

a ribbon of essentially moisture vapor impervious material having a portion of its width adhered to said second surface of said spacer element and another portion of its width sealed to edge surface portions of said added pane around the perimeter of said added pane; and a layer of sealant interposed between said installed pane and the portion of said ribbon which is adhered to said second surface of said spacer element, forming a resilient structural bond and a hermetic seal therebetween.

27. A multiple glazed installation comprising:

a building wall having an opening defined by a frame member;

an installed transparent pane having its peripheral edges retained in said frame member;

an added transparent pane overlying said installed pane within the outline of said frame member, in generally parallel, spaced relation to said installed pane;

an elongated, rigid spacer element, formed from essentially moisture vapor impervious material, disposed between opposing major surfaces of said panes, adjoining marginal portions of the opposed major surface of said added pane around the perimeter of said added pane so as to define an enclosed space between said panes, each longitudinal portion of said spacer having a first surface facing said added pane, a second surface facing said installed pane, and a third surface substantially perpendicular to said first and second surfaces on the exterior of said enclosed space;

a ribbon of essentially moisture vapor impervious material extending around the perimeter of the added pane, sealed to said third surface of said spacer assembly and to edge surface portions of said added pane; and a layer of sealant interposed between said installed pane and said second surface of said spacer element, forming a resilient structural bond and a hermetic seal therebetween.

28. A method of increasing the insulating value of a vision opening in a building wall structure glazed with an installed transparent pane, comprising the steps of:

providing at an installation site a subassembly which includes an additional transparent pane and a spacer element affixed to marginal portions of one major surface of said additional pane, having a hermetically sealed barrier against moisture penetration through said spacer element and between said spacer and said pane;

aligning said subassembly in a generally parallel relationship to a major surface of the installed pane, with said spacer element disposed between said panes, and with a band of an at least partially uncured sealant disposed between said spacer element and said installed pane, said sealant being comprised of a polymeric composition having a moisture vapor transmittance of less than about 15 grams of water per 24 hours per square meter for 1 mil thickness and being coherent and tacky but flowable under pressure at room temperature; and biasing said subassembly onto said major surface of the installed pane and applying a compressive force on said sealant band therebetween until the sealant flows and forms a resilient structural bond and a hermetic seal between said spacer element and said major surface of said installed pane.

29. The method of claim 28 wherein said spacer element is sealed onto said additional pane at said installation site.

30. The method of claim 29 wherein the sealing of said spacer element onto said additional pane includes the step of adhering a ribbon of essentially moisture vapor impervious material onto said spacer element and peripheral edge surface portions of said additional pane around the perimeter of said additional pane.

31. The method of claim 28 wherein said subassembly is provided at said installation site in prefabricated form.

32. A method of increasing the insulating value of a vision opening in a building wall structure glazed with an installed transparent pane, comprising the steps of:

applying a spacer element onto marginal portions of a major surface of an additional transparent pane around the perimeter of said additional pane, and spacing said spacer element from peripheral edges of said addition pane;

adhering a body of sealant to said major surface of said additional pane between said spacer element and the peripheral edges of said additional pane, said body of sealant being applied with a thickness in the direction normal to said major surface greater than that of said spacer element, said sealant being comprised of an at least partially uncured polymeric composition having a moisture vapor transmittance of at least 15 grams of water per 24 hours per square meter for 1 mil thickness and which, at room temperaure, is coherent and tacky but flowable under pressure;

aligning said subassembly in a generally parallel relationship to a major surface of the installed pane, with said spacer element and said sealant disposed between said panes; and biasing the additional pane toward the installed pane to contact said major surface of the installed pane with said body of sealant and applying a compressive force on said body of sealant until the sealant flows and forms a resilient structural bond and a hermetic seal between said panes.

* * * * *

UNITED STATES PATENT AND TRADEMARK OFFICE

CERTIFICATE OF CORRECTION

PATENT NO. : 3,971,178

DATED : July 27, 1976

INVENTOR(S) : Renato J. Mazzoni, George H. Bowser and Richard R. Lewchuk

It is certified that error appears in the above-identified patent and that said Letters Patent are hereby corrected as shown below:

Column 12, line 2, Claim 10, before "material" please insert --metallic--

Column 14, line 32, Claim 26, "sad" should be --said--.

Signed and Sealed this

Twelfth Day of October 1976

[SEAL]

*Attest:*

RUTH C. MASON
*Attesting Officer*

C. MARSHALL DANN
*Commissioner of Patents and Trademarks*